US011027570B2

(12) United States Patent
Scholz

(10) Patent No.: US 11,027,570 B2
(45) Date of Patent: Jun. 8, 2021

(54) MULTI-PURPOSE ABSORBENT CARD

(71) Applicant: Soak It Up, St. Paul, MN (US)

(72) Inventor: Carla Scholz, St. Paul, MN (US)

(73) Assignee: CC Scholz Design Inc., Roseville, MN (US)

( * ) Notice: Subject to any disclaimer, the term of this patent is extended or adjusted under 35 U.S.C. 154(b) by 0 days.

(21) Appl. No.: 16/028,170

(22) Filed: Jul. 5, 2018

(65) Prior Publication Data

US 2019/0084336 A1 Mar. 21, 2019

Related U.S. Application Data

(60) Provisional application No. 62/529,470, filed on Jul. 6, 2017.

(51) Int. Cl.

| | |
|---|---|
| ***B42D 15/04*** | (2006.01) |
| ***A47L 13/16*** | (2006.01) |
| ***B42D 15/02*** | (2006.01) |

(52) U.S. Cl.

CPC ..... *B42D 15/042* (2013.01); *A47L 13/16* (2013.01); *B42D 15/027* (2013.01); *B42D 15/04* (2013.01); *B42P 2241/10* (2013.01)

(58) Field of Classification Search

CPC .... B42D 15/042; B42D 15/04; B42D 15/027; A47L 13/16; A47L 13/10; A47L 13/006; B42P 2241/10

See application file for complete search history.

(56) References Cited

U.S. PATENT DOCUMENTS 2,865,283 A * 12/1958 Stoffer ..... A47L 1/15 100/40
4,242,957 A * 1/1981 Mascioni ..... B41F 15/10 101/126
5,470,301 A * 11/1995 Brunt, II ..... B42D 15/008 40/539
6,347,471 B1 * 2/2002 Mirza ..... G09F 15/0025 40/594
7,124,465 B1 * 10/2006 Kaminstein ..... A47L 13/16 15/244.3

(Continued)

FOREIGN PATENT DOCUMENTS

CA 2956466 A1 * 7/2018 ..... B42D 15/042
CN 201905854 U * 7/2011

(Continued)

OTHER PUBLICATIONS

TekoTryck, The Sponge Cloth-Environmentally friendly and compostable "Anneko Dish Cloth Card" https://web.archive.org/web/20160701020135/http://tekotryck.se/disktrasor/?lang=en Jul. 1, 2016.*

(Continued)

*Primary Examiner* — Cassandra Davis
(74) *Attorney, Agent, or Firm* — Mueting Raasch Group

(57) ABSTRACT

The technology disclosed herein relates to a card having a liquid absorptive sponge cloth forming a first panel and a second panel. A fold line is defined between the first panel and the second panel. A printed communication is on a first surface of the first panel. The sponge cloth is semi-rigid when substantially dry and is non-rigid upon saturation with liquid water. The sponge cloth has a maximum tensile strength of at least 2.66 lbs./in when wet.

15 Claims, 7 Drawing Sheets

(56) References Cited

U.S. PATENT DOCUMENTS

| | | | | |
|---|---|---|---|---|
| 2002/0006763 | A1* | 1/2002 | Forbes | A63F 9/0666 446/1 |
| 2003/0004997 | A1* | 1/2003 | Parker | G06Q 30/02 705/4 |
| 2004/0154195 | A1* | 8/2004 | Jewell | G09F 1/00 40/124.01 |
| 2005/0091886 | A1* | 5/2005 | Kim | A63H 33/16 40/124.09 |
| 2006/0272185 | A1* | 12/2006 | Malama | B42D 1/10 40/124.01 |
| 2015/0336415 | A1* | 11/2015 | Fetters | B42D 15/042 40/124.09 |
| 2019/0104918 | A1* | 4/2019 | Carlson | B32B 5/18 |

FOREIGN PATENT DOCUMENTS

| | | | | |
|---|---|---|---|---|
| DE | 198 49 807 | A1 | 5/2000 | |
| DE | 19849807 | A1 * | 5/2000 | A47K 7/02 |
| DE | 20003106 | U1 * | 5/2000 | B42D 15/02 |

OTHER PUBLICATIONS

Onsalechina.com, Compressed Sponge Cloth Card. file:///C:/Users/cdavis/Documents/e-Red%20Folder/16028170/Compressed%20Sponge%20Cloth%20Card%20Wholesale%20China%20%20Osc%20Wholesale.pdf.*

High School Graduation Products Catalog, Issuu, (Jul. 14, 2016) https://issuu.com/jostenspublications/docs/151640_apa-175_gdp_sy17_grad_prod_c/3 (Year: 2014).*

Translation of Hong Zhenhui, Chinese Patent CN 201905854 U (Year: 2011).*

"Kalle L200," Specification Information retrieved from <http://sponge-cloth.kalle.de/sponge-cloths/product-types/1200/> Jun. 13, 2018 (5 pages).

"Kalle N250," Specification Information retrieved from <http://sponge-cloth.kalle.de/sponge-cloths/product-types/n250/> Jun. 13, 2018 (5 pages).

"Kalle S100," Specification Information retrieved from <http://sponge-cloth.kalle.de/sponge-cloths/product-types/s100/> Jun. 13, 2018 (4 pages).

"Soak it Up Cloths—About Us," <http://www.soakitupcloths.com/abaoutus.asp> Oct. 2017, retrieved Aug. 15, 2018 (2 pages).

"Soak it Up Cloths—Homepage," <http://soakitupcloths.com/default.asp> Oct. 2017, retrieved Aug. 15, 2018 (4 pages).

"Soak it Up Cloths—Products," <http://www.soakitupcloths.com/Swedish-dishcloths-s/136.htm> Oct. 2017, retrieved Aug. 15, 2018 (2 pages).

"Defined physical properties", *Iggesund Paperboard Reference Manual*, 2010, Iggesund Paperboard AB, Iggesund, Sweden. Title page, publication page, table of contents, pp. 125-127. Available online at <https://www.iggesund.com/en/knowledge/knowledge-publications/the-reference-manual/>.

"Filament tape", Wikipedia., obtained online Jul. 1, 2019, 2 pages. Available online at <https://en.wikipedia.org/wiki/Filament_tape>.

"Ultimate tensile strength", Wikipedia, obtained online Jul. 1, 2019, 11 pages. Available online at https://en.wikipedia.org/wiki/Ultimate_tensile_strength>.

* cited by examiner

MULTI-PURPOSE ABSORBENT CARD

This application is a non-provisional application claiming priority to U.S. Provisional Application No. 62/529,470 filed Jul. 6, 2017 and the entire contents of the U.S. Provisional Application are incorporated herein by reference.

FIELD OF THE TECHNOLOGY

The technology disclosed herein generally related to a card. More particularly, the technology disclosed herein relates to a multi-purpose absorbent card.

SUMMARY

The technology disclosed herein relates to a card having a liquid absorptive sponge cloth forming a first panel and a second panel. A fold line is defined between the first panel and the second panel. A printed communication is on a first surface of the first panel. The sponge cloth is semi-rigid when substantially dry and is non-rigid upon saturation with liquid water. The sponge cloth has a maximum tensile strength of at least 2.66 lbs./in when wet.

In some embodiments, the fold line includes perforations. Additionally or alternatively, the fold line is a crease. Additionally or alternatively, the fold line is defined by a line of compression in the sponge cloth between the first panel and the second panel. Additionally or alternatively, the fold line is defined by a first sheet of material, where the first sheet of material is a material alternate to the sponge cloth and the first sheet of material bonds the first panel and the second panel. In some embodiments, the first sheet of material is paper.

In some embodiments, the sponge cloth is constructed of cellulose and cotton fibers. Additionally or alternatively, the sponge cloth is configured to absorb at least 0.15 quarts of water per square foot. Additionally or alternatively, the card is a greeting card. Additionally or alternatively, the card has a paper insert disposed between the first panel and second panel, wherein the paper insert is coupled to the card. Additionally or alternatively, the printed communication can be a drawing, a greeting, an instruction, an advertisement, an invitation, a well-wish, or a product tag.

In some embodiments, the technology is related to a card having a liquid absorptive sponge cloth defining a panel having a first surface and an opposite second surface, wherein the sponge cloth is semi-rigid when substantially dry and is non-rigid upon saturation with liquid water. A printed communication is on the first surface, and a postage indicator printed on the second surface. The sponge cloth has a maximum tensile strength of at least 2.66 lbs./in when wet.

In some embodiments, the sponge cloth is constructed of cellulose and cotton fibers. Additionally or alternatively, the sponge cloth is configured to absorb at least 0.15 quarts of water per square foot. In some such embodiments, the sponge cloth is configured to adsorb at least 0.20 quarts/ft$^2$. Additionally or alternatively, the card is a postcard. Additionally or alternatively, the printed communication can be a drawing, a greeting, an instruction, an advertisement, an invitation, a well-wish, or a product tag. Additionally or alternatively, the sponge cloth has a second printed communication on the second surface, wherein the second printed communication is designated to receive a mailing address. Additionally or alternatively, the sponge cloth has a maximum stretch of at least 10% when wet.

In some embodiments, the technology disclosed herein relates to a hang tag having a liquid absorptive sponge cloth forming first panel and a first opening through the first panel. A hanger is disposed through the first opening of the first panel. A printed communication is on a first surface of the first panel. The sponge cloth is semi-rigid when substantially dry and is non-rigid upon saturation with liquid water. The sponge cloth has a maximum tensile strength of at least 2.66 lbs./in when wet.

In some embodiments, the sponge cloth further defines a second panel. Additionally or alternatively, the sponge cloth defines a second opening in the second panel, and the hanger is disposed through the second opening. Additionally or alternatively, the sponge cloth is configured to absorb at least 0.15 quarts of water per square foot.

In some embodiments, the technology disclosed herein relates to a hanger having a liquid absorptive sponge cloth forming a first panel having a first edge and an opening through the first panel. The opening has a main portion that is configured to receive a structure and a slit portion that extends from the first edge to the main portion. A printed communication is on the first surface of the first panel. The sponge cloth is semi-rigid when substantially dry and is non-rigid upon saturation with liquid water. The sponge cloth has a maximum tensile strength of at least 2.66 lbs./in when wet.

In some embodiments the hanger is a door hanger and the main portion of the opening is configured to receive a door handle. Additionally or alternatively, a hanger is a product hanger and the main portion of the opening is configured to receive a portion of a product.

Figure 1:
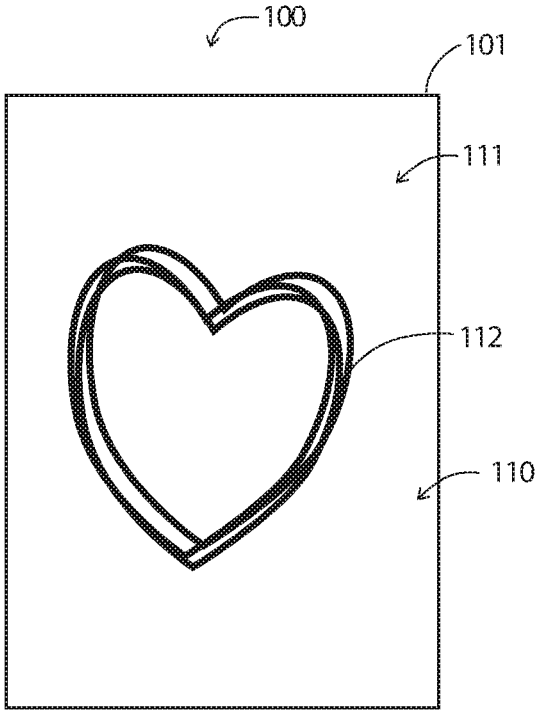
FIG. 1 depicts a facing view of a first side of an example card consistent with the technology disclosed herein.

The current technology may be more completely understood and appreciated in consideration of the following detailed description of various embodiments of the current technology in connection with the accompanying drawings.

DETAILED DESCRIPTION

The current technology relates to constructing various products that have been previously made with paper, cardstock, and/or paperboard (hereinafter cumulatively referred to as "paper") with an absorbent sponge cloth. Constructing various products from such an absorbent sponge cloth allows for such a product to be used for its primary, original purpose, but then also for a secondary purpose as a sponge cloth for cleaning, polishing, crafting, make-up application, and the like. For example, greeting cards, door hangers, post cards, product labels/hang tags, and instruction manuals, when constructed of an absorbent sponge cloth, each achieve a secondary purpose as a sponge, which extends the useful life of the product and slows or eliminates the product's journey to a landfill.

The technology disclosed herein relates to a card having a liquid absorptive sponge cloth forming a first panel and a second panel. A fold line is defined between the first panel and the second panel. A printed communication is on a first surface of the first panel. The sponge cloth is semi-rigid when substantially dry and is non-rigid upon saturation with liquid water. The sponge cloth has a maximum tensile strength of at least 2.66 lbs./in when wet.

In some embodiments, the fold line includes perforations. Additionally or alternatively, the fold line is a crease. Additionally or alternatively, the fold line is defined by a line of compression in the sponge cloth between the first panel and the second panel. Additionally or alternatively, the fold line is defined by a first sheet of material, where the first sheet of material is a material alternate to the sponge cloth and the first sheet of material bonds the first panel and the second panel. In some embodiments, the first sheet of material is paper.

In some embodiments, the sponge cloth is constructed of cellulose and cotton fibers. Additionally or alternatively, the sponge cloth is configured to absorb at least 0.15 quarts of water per square foot. Additionally or alternatively, the card is a greeting card. Additionally or alternatively, the card has a paper insert disposed between the first panel and second panel, wherein the paper insert is coupled to the card. Additionally or alternatively, the printed communication can be a drawing, a greeting, an instruction, an advertisement, an invitation, a well-wish, or a product tag.

In some embodiments, the technology is related to a card having a liquid absorptive sponge cloth defining a panel having a first surface and an opposite second surface, wherein the sponge cloth is semi-rigid when substantially dry and is non-rigid upon saturation with liquid water. A printed communication is on the first surface, and a postage indicator printed on the second surface. The sponge cloth has a maximum tensile strength of at least 2.66 lbs./in when wet.

In some embodiments, the sponge cloth is constructed of cellulose and cotton fibers. Additionally or alternatively, the sponge cloth is configured to absorb at least 0.15 quarts of water per square foot. In some such embodiments, the sponge cloth is configured to adsorb at least 0.20 quarts/ft$^2$. Additionally or alternatively, the card is a postcard. Additionally or alternatively, the printed communication can be a drawing, a greeting, an instruction, an advertisement, an invitation, a well-wish, or a product tag. Additionally or alternatively, the sponge cloth has a second printed communication on the second surface, wherein the second printed communication is designated to receive a mailing address. Additionally or alternatively, the sponge cloth has a maximum stretch of at least 10% when wet.

In some embodiments, the technology disclosed herein relates to a hang tag having a liquid absorptive sponge cloth forming first panel and a first opening through the first panel. A hanger is disposed through the first opening of the first panel. A printed communication is on a first surface of the first panel. The sponge cloth is semi-rigid when substantially dry and is non-rigid upon saturation with liquid water. The sponge cloth has a maximum tensile strength of at least 2.66 lbs./in when wet.

In some embodiments, the sponge cloth further defines a second panel. Additionally or alternatively, the sponge cloth defines a second opening in the second panel, and the hanger is disposed through the second opening. Additionally or alternatively, the sponge cloth is configured to absorb at least 0.15 quarts of water per square foot.

In some embodiments, the technology disclosed herein relates to a hanger having a liquid absorptive sponge cloth forming a first panel having a first edge and an opening through the first panel. The opening has a main portion that is configured to receive a structure and a slit portion that extends from the first edge to the main portion. A printed communication is on the first surface of the first panel. The sponge cloth is semi-rigid when substantially dry and is non-rigid upon saturation with liquid water. The sponge cloth has a maximum tensile strength of at least 2.66 lbs./in when wet.

In some embodiments the hanger is a door hanger and the main portion of the opening is configured to receive a door handle. Additionally or alternatively, a hanger is a product hanger and the main portion of the opening is configured to receive a portion of a product.

Sponge Cloths

Sponge cloths consistent with the technology disclosed herein are generally a woven or non-woven fabric constructed of fibers. The fibers can be natural and/or synthetic fibers. In some embodiments the sponge cloths are constructed of cellulose fibers. In some embodiments the sponge cloths are constructed of fibers limited to wood cellulose and cotton fibers. In some examples the sponge cloth is constructed of 70% wood cellulose fibers and 30% cotton fibers by weight. In some embodiments the sponge cloths are constructed of recycled fibers. In various embodiments, the sponge cloths are compostable.

The sponge cloths are generally configured to absorb liquids, such as liquid water. In various embodiments, the sponge cloths are configured to absorb at least 0.15 quarts/ft$^2$ (1.5 L/m$^2$) of water per unit area of cloth. In some embodiments, the sponge cloths are configured to absorb at least 0.20 quarts/ft$^2$ (2 L/m$^2$) of water per unit area of cloth. In some embodiments, the sponge cloths are configured to absorb at least 0.25 quarts/ft$^2$ (2.55 L/m$^2$) of water per unit area of cloth. In some embodiments the sponge cloths are configured to absorb between 0.20 quarts/ft$^2$ (2 L/m$^2$) and 0.50 quarts/ft$^2$ (5 L/m$^2$) of water per unit area of cloth. In some embodiments sponge cloths consistent with the technology disclosed herein are produced by Kalle GmbH in Wiesbaden, Germany.

The sponge cloths consistent with the current technology are generally semi-rigid when substantially dry, and are non-rigid upon saturation with liquid water. "Semi-rigid" is defined herein as self-supporting such that the sponge cloth substantially maintains its structure and shape under the force of gravity (such as when the sponge cloth is picked up, for example), similar to a cardstock. However, it's important to note that the sponge cloth need not perfectly maintain its shape and, much like cardstock, the substantially dry sponge cloth may flex under the force of gravity. "Substantially dry" is used herein to mean that the sponge cloth contains no more than 2% by mass of liquid such as liquid water. A substantially dry sponge cloth can feel dry to the touch. "Non-rigid" is defined herein as a structure that is not self-supporting and, as such, does not maintain its shape under the force of gravity, similar to a towel.

Within its useful life, a sponge cloth that is saturated with water maintains structural integrity, and can become relatively pliable and flexible when saturated, as compared to a substantially dry sponge cloth. In some embodiments, the sponge cloths have a maximum tensile strength of at least 1.90 lbs./in. (5 N/15 mm, 2.66 lbs./in. (7 N/15 mm), 3.05 lbs./in. (8 N/15 mm, or 7.61 lbs./in. (20 N/15 mm when wet with water. In some embodiments the sponge cloths have a maximum tensile strength between 1.90 lbs./in. (5 N/15 mm or 2.66 lbs./in. (7 N/15 mm and 11.42 lbs./in. (30 N/15 mm. In some embodiments, the sponge cloths have a maximum tensile strength of about 7.61 lbs./in. (20 N/15 mm or about 9.52 lbs./in. (25 N/15 mm when wet.

Sponge cloths consistent with the technology disclosed herein can have some elasticity when saturated with water. For example, when saturated with water, a sponge cloth can have a maximum stretch of at least 10% in some embodiments. In some embodiments, when wet, the sponge cloth can have a maximum stretch of at least 20%.

Sponge cloths are generally relatively durable, as can be demonstrated by Veslic abrasion tests, which defines a number of rub cycles that a sponge cloth can withstand. In some embodiments the sponge cloth can withstand at least 50, 60, or 70 rub cycles. In some embodiments the sponge cloth can withstand at least 80 or 90 rub cycles.

A sponge cloth is generally configured to maintain its structural integrity in at least a single wash in a dishwasher or washing machine; in this way the sponge cloths, as disclosed herein, are more durable than paper when wet. In some embodiments sponge cloths are configured to maintain structural integrity after multiple washes in a dishwasher or washing machine. Sponge cloths may break down or degenerate after a particular number of washes in a dishwasher or washing machine, however, such as after 4 wash cycles, 15 wash cycles, 50 wash cycles, or 200 wash cycles.

When substantially dry, a sponge cloth as-disclosed generally forms a semi-rigid panel that is generally planar in nature, although in various embodiments one or both main surfaces of the panel are not necessarily perfectly planar. In various embodiments one or both opposite surfaces of the sponge cloth has a textured surface such as patterned embossments. The sponge cloths will generally be sized to in accordance with its use, but will generally have a thickness ranging between 0.5 mm (0.02 inches) and 4 mm (0.16 inches) when substantially dry. In some embodiments a substantially dry sponge cloth has a thickness ranging between 0.5 mm (0.02 inches) and 2 mm (0.08 inches). When saturated with water, sponge cloths can have a thickness between 1 mm (0.04 in.) and 6 mm (0.20 in.) Sponge cloths consistent with the technology disclosed herein can have a mass per unit area of at least 80 grams/$m^2$ (0.26 oz./$ft^2$), 85 grams/$m^2$ (0.28 oz./$ft^2$), or 90 grams/$m^2$ (0.29 oz./$ft^2$). Sponge cloths consistent with the technology disclosed herein can have a mass per unit area of less than 300 grams/$m^2$ (0.98 oz./$ft^2$), 280 grams/$m^2$ (0.92 oz./$ft^2$), or 250 grams/$m^2$ (0.82 oz./$ft^2$).

Figures

Figure 2:
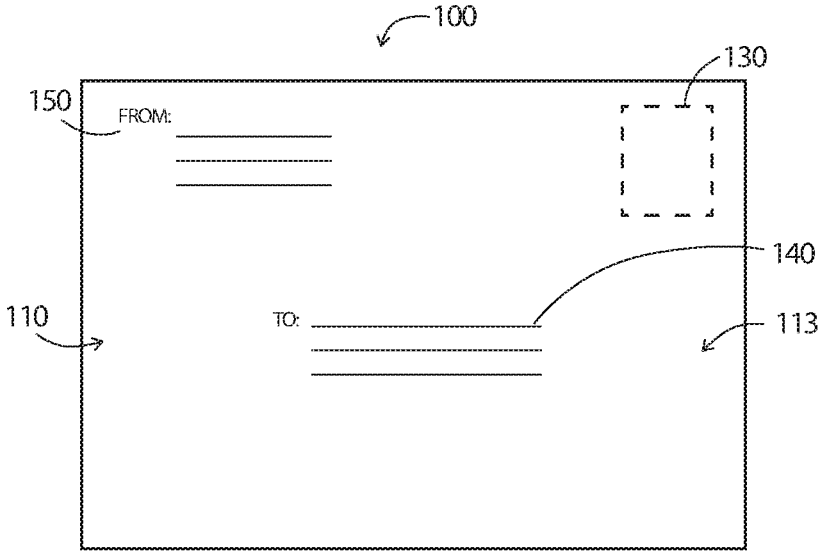
FIG. 2 depicts a facing view of a second, opposite side of the example card of FIG. 1.

FIGS. 1 and 2 depict an example card 100 consistent with some examples. The card 200 is generally configured as a postcard. The card 100 has a panel 110 defining a first surface 111 and an opposite second surface 113. A printed communication 112 is on the first side of the panel 110, and a postage indicator 130 is printed on the second surface 113, which is configured to receive postage for mailing. The printed communication 112 is generally information that is printed directly on the panel 110. The printed communication can be a variety of types of information, such as a message and/or a drawing. The message can be a greeting, instruction, advertisement, product information, and the like. The printed communications as disclosed herein can be achieved through screen printing, letterpress, digital printing, and the like.

In the current example, the second surface 113 of the card 100 (FIG. 2) additionally has printed regions 140, 150 related to the mailing information associated with the card 100. A first printed region 140 is designated to receive a recipient's address, and a second printed region 150 is designated to receive a return address. In some embodiments one or both of the first printed region 140 and the second printed region 150 can be omitted. In some embodiments, one or both of the first printed region 140 and the second printed region 150 are directly disposed on the second surface 113. In some embodiments, one or both of the first printed region 140 and the second printed region 150 are printed on labels that are affixed to the card 100.

Unlike existing postcards, the current card 100 is constructed of a liquid absorptive sponge cloth 101, which forms the panel 110. Sponge cloths consistent with the technology disclosed herein are described in detail above.

Figure 3:
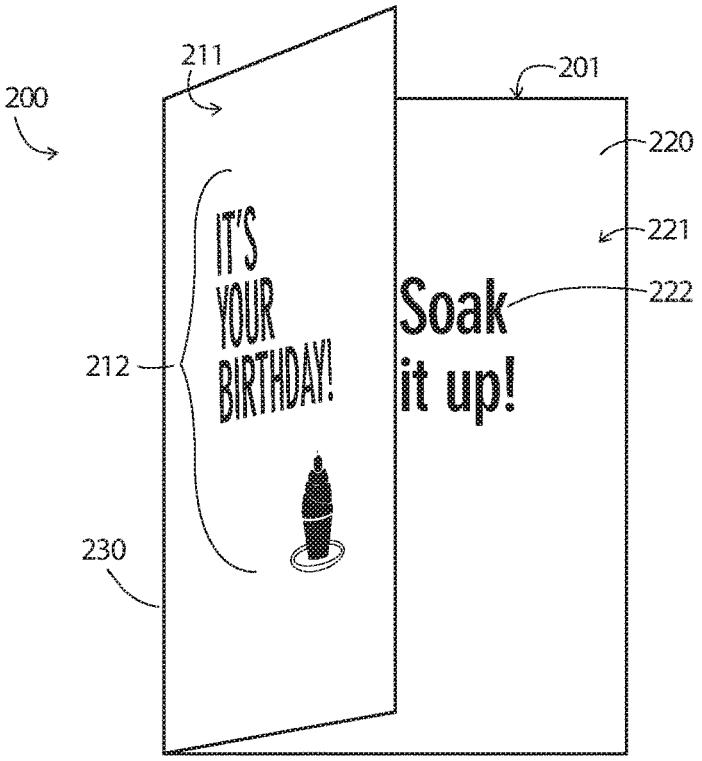
FIG. 3 depicts a perspective view of another example card consistent with the technology disclosed herein.
Figure 4:
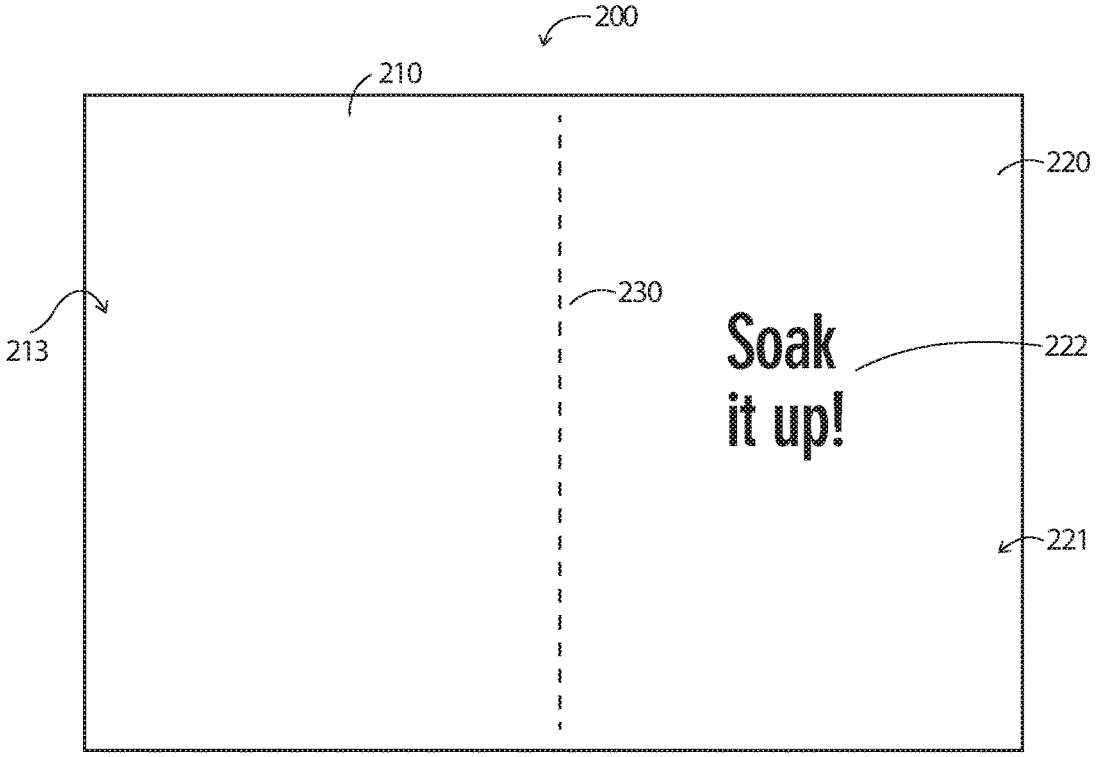
FIG. 4 depicts a facing view of the inside surfaces of the card of FIG. 3.

FIGS. 3 and 4 depict another example card 200 constructed of a liquid absorptive sponge cloth 201. A card 200 defines a first panel 210 and a second panel 220. A fold line 230 is defined between the first panel 210 and the second panel 220. A printed communication 212 is on a first surface 211 of the first panel 210. Similar to the example of FIGS. 1 and 2, the sponge cloth is semi-rigid when substantially dry and is non-rigid upon saturation with liquid water.

In the current embodiment, the sponge cloth 201 forming the first panel 210 and the second panel 220 is a cohesive sheet, and the fold line 230 can be a crease that's defined between the first panel 210 and the second panel 220. The fold line 230 can additionally or alternatively be defined by perforations defined in the sponge cloth 201 between the first panel 210 and the second panel 220. Additionally or alternatively, the fold line 230 can be defined by a line of compression across the sponge cloth 201 between the first panel 210 and the second panel 220.

In the current embodiment, the card 200 is a greeting card and, in particular, a birthday card. The first printed communication 212 can be considered a greeting. A first surface 221 of the second panel 220 of the card 200 has a second printed communication 222 for a recipient to view upon opening the greeting card 200.

In some embodiments, a second surface 213 opposite the first surface 211 of the first panel 210 can have a printed communication disposed thereon. Similarly, in some embodiments, a second surface (not visible) opposite the first surface 221 of the second panel 220, which is the back surface of the card 200, can have a printed communication disposed thereon. For example, a company name or trademark can be printed on the back surface of the card 200.

Figure 5:
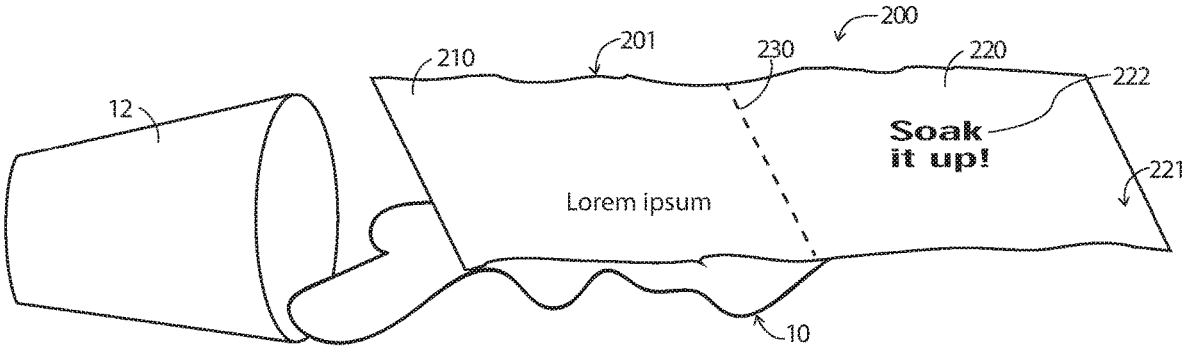
FIG. 5 depicts an example implementation of the technology disclosed herein.

FIG. 5 demonstrates an example implementation of the greeting card 200 of FIGS. 3-4. Because the greeting card 200 is constructed of sponge cloth 201, it allows the greeting card 200 to be used for its primary purpose: as a greeting card, but also for secondary purposes consistent with a sponge cloth 201 such as cleaning, polishing, crafting, make-up application, and the like. In the current example implementation, the greeting card 200 is used to absorb a liquid 10 that spilled out of a cup 12. Each of the example embodiments disclosed herein can similarly have such secondary uses, which extends the useful life of the product.

Figure 6:
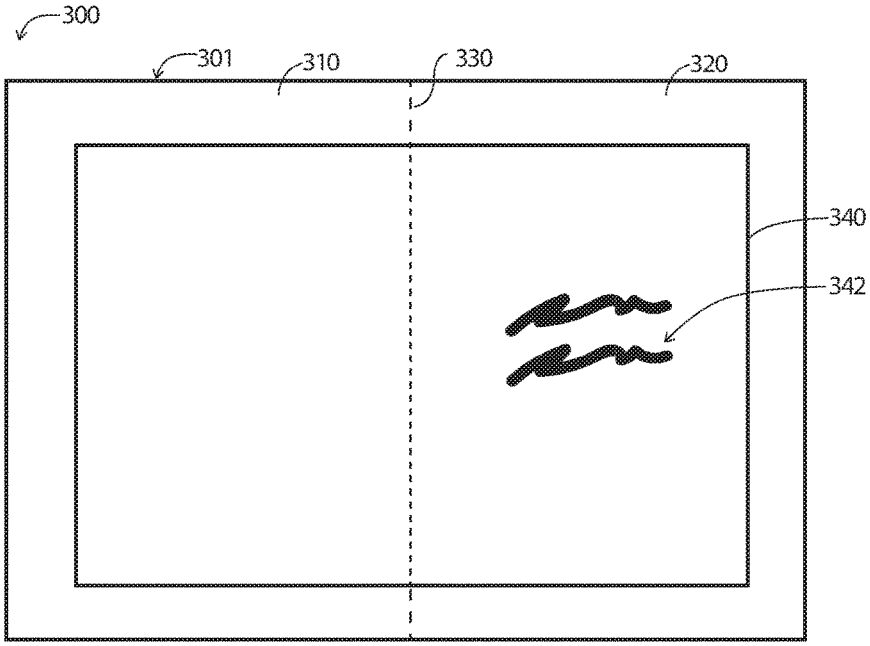
FIG. 6 depicts a facing view of the inside of a card consistent with the technology disclosed herein.

In some embodiments, various printed communications can be disposed on the surface of an alternate material, such as a piece of paper, that can be coupled to the card. FIG. 6 depicts such an example. Similar to the embodiment discussed above, a sponge cloth 301 forms a card 300 having a first panel 310 and a second panel 320. A fold line 330 is defined between the first panel 310 and the second panel 320. The fold line 330 can be similar to fold lines discussed above. A printed communication can be on a first surface of the first panel (although not visible in this view).

In some examples, including the one depicted, the card 300 has a paper insert 340 disposed between the first panel 310 and the second panel 320. The paper insert 340 can cooperatively define at least a portion of the fold line 330. The paper insert 340 is coupled to the card 300. The paper insert 340 can be coupled to the card 300 with glue, thread, staples, grommets/eyelets, and/or tape, as examples. A message 342 can be written on the paper insert to the intended recipient, such as a greeting, a well-wish, an advertisement, instructions, an invitation, and the like. In some embodiments it can be desirable to include content on a paper insert 340 so that such information can be preserved as a memento or for further reference (such as event information).

The paper insert 340 can have a variety of configurations. While the paper insert 340 is depicted as smaller than the outer dimensions of the card 300, in some embodiments the paper insert can be the same length and width as the combined first panel 310 and second panel 320 of the card 300. As will be discussed below, in some embodiments the paper insert can be sized to fit on a surface of only one of the first panel 310 or the second panel 320.

Figure 7:
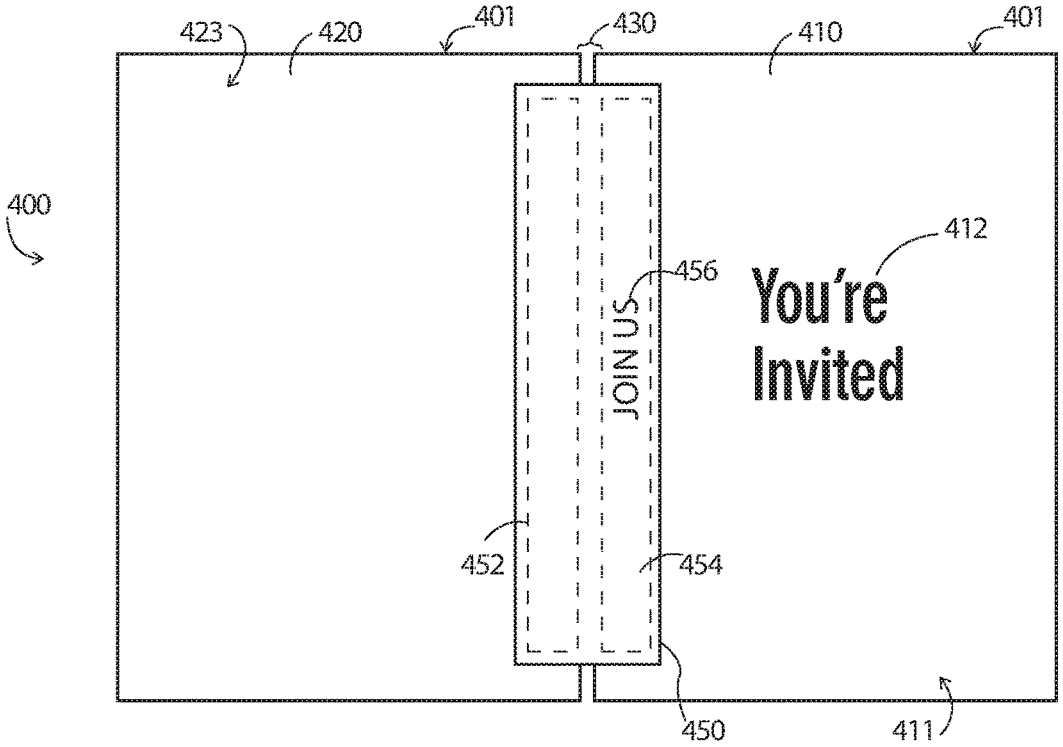
FIG. 7 depicts a facing view of the outside surfaces of an example card consistent with the technology disclosed herein.
Figure 8:
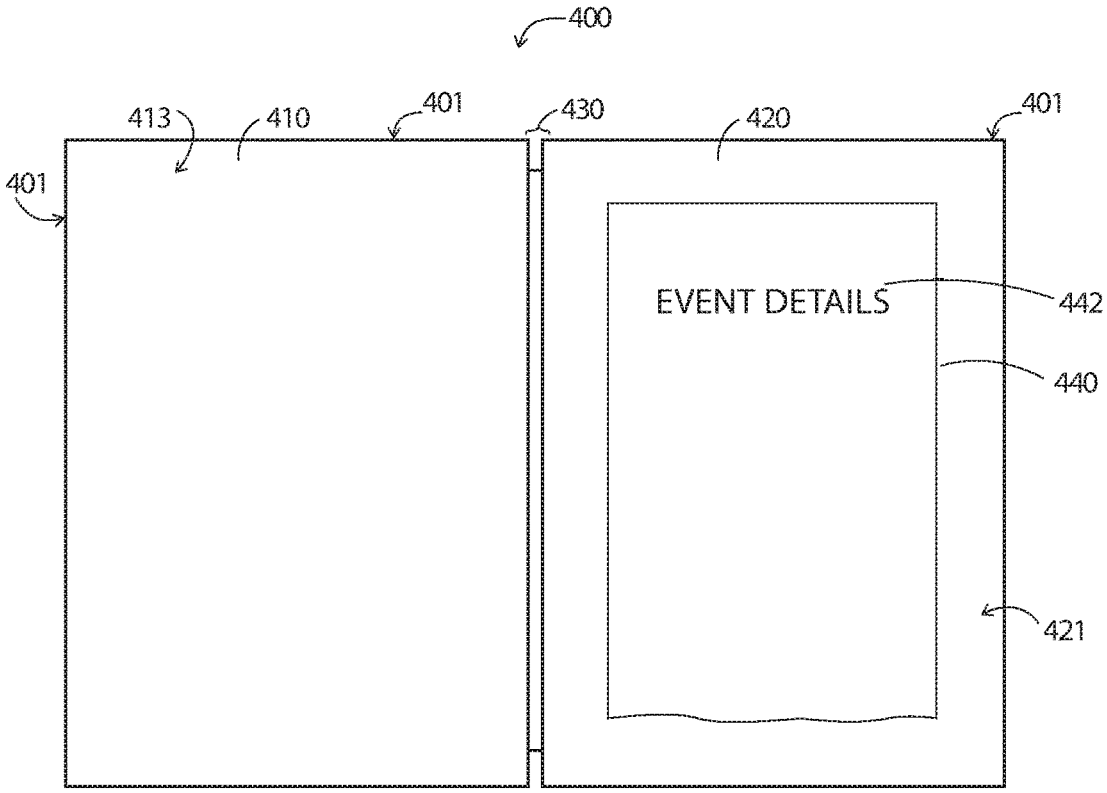
FIG. 8 depicts a facing view of the inside surfaces of the example card of FIG. 7.
Figure 9:
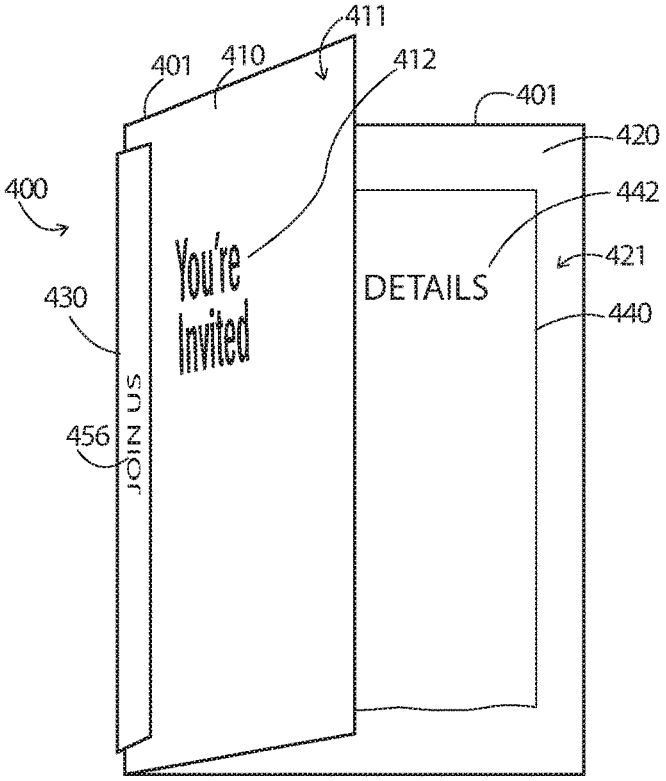
FIG. 9 depicts a perspective view of the example card of FIGS. 7 and 8.

FIGS. 7-9 depicts another example card 400 consistent with the current technology, where FIG. 7 is a view of the outside surfaces 411, 423; FIG. 8 is a view of the inside surfaces 413, 421; and FIG. 9 is a perspective view of the partially opened card 400 in a folded configuration. In this example, the card 400 is an invitation. Similar to the embodiments disclosed above, a liquid absorptive sponge cloth 401 forms the card 400 that has a first panel 410 and a second panel 420. A fold line 430 is defined between the first panel 410 and the second panel 420. A printed communication 412 is disposed on a first surface 411 of the first panel 410.

In the present example, however, the first panel 410 and the second panel 420 are discrete, non-cohesive sheets. The first panel 410 and the second panel 420 are separate sheets that are bonded by a first sheet of material 450 that defines the fold line 430 between the first panel 410 and the second panel 420. The first panel 410 and the second panel 420 can each be bonded to the first sheet of material 450 with glue, thread, tape, and the like. The first panel 410 can be bonded to the first sheet of material 450 in a first bonding region 452 and the second panel 420 can be bonded to the first sheet of material 450 in a second bonding region 454. While the first sheet of material 450 is depicted as extending a portion of the length of the first panel 410 and the second panel 420, in some embodiments the first sheet of material 450 extends along the entire length of the first panel 410 and the second panel 420.

The first sheet of material 450 can be a variety of materials and combinations of materials. In various embodiments the first sheet of material 450 is a material alternate to the sponge cloth 401 such as paper, fabric, or plastic. The fold line 430 can be a crease or perforations defined in the first sheet of material 450 along its length, but in some embodiments the fold line 430 is merely a region of the first sheet of material 450 that bends freely to allow the first panel 410 and the second panel 420 to be stacked in a greeting card configuration.

In the current example, a second printed communication 456 is disposed on the first sheet of material 450. The second printed communication 456 is information related to the invitation, but in some other embodiments the second printed communication 456 can reflect information related to the use of the sponge cloth 401. In some other embodiments, the second printed communication 456 can reflect information related to the use of the sponge cloth 401. Other information can also be reflected in the second printed communication.

A paper insert 440 (FIG. 8), alternate to the paper insert design depicted in FIG. 6, is incorporated in the card 400 of the current example. The paper insert 440 is disposed between the first panel 410 and the second panel 420 (relative to the greeting card configuration of FIG. 9), and the paper insert 440 is coupled to the card 400. In particular, the paper insert 440 is sized to fit within the first surface 421 of the second panel 420. In some embodiments the paper insert 440 has the same length and width as the first surface 421 of the second panel 420. The paper insert 440 is coupled to the first surface 421 of the second panel 420. The paper insert 440 can be coupled to the card through structures described above with reference to FIG. 6. In some embodiments a second paper insert can be coupled to the second surface 413 of the first panel 410.

A printed communication 442 is disposed on the paper insert 440, where the printed communication 442 can be similar to those already described. In the current example, the printed communication 442 reflects event details for the invitation.

Figure 10:
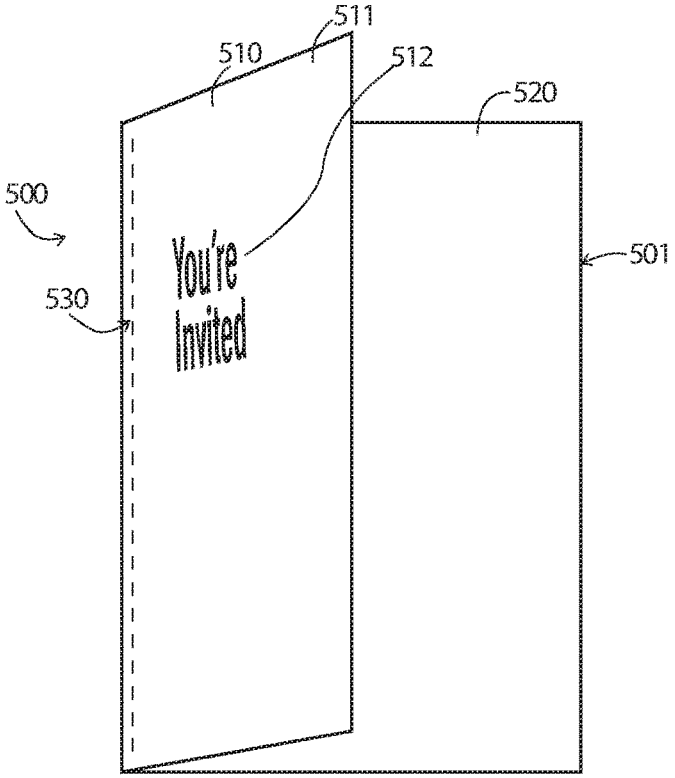
FIG. 10 depicts a perspective view of another example card consistent with the technology disclosed herein.

FIG. 10 depicts another example embodiment. Similar to the embodiments disclosed above, a liquid absorptive sponge cloth 501 forms the card 500 that has a first panel 510 and a second panel 520. A fold line 530 is defined between the first panel 510 and the second panel 520. A printed communication 512 is disposed on a first surface 511 of the first panel 510. In this example, the card 500 is a greeting card.

In this particular embodiment, the first panel 510 and the second panel 520 are discrete, non-cohesive sheets of sponge cloth 501 that are coupled to define the fold line 530. The first panel 510 and second panel 520 can be stitched/sewn, stapled, grommeted, glued, or taped together along the fold line 530.

Figure 11:
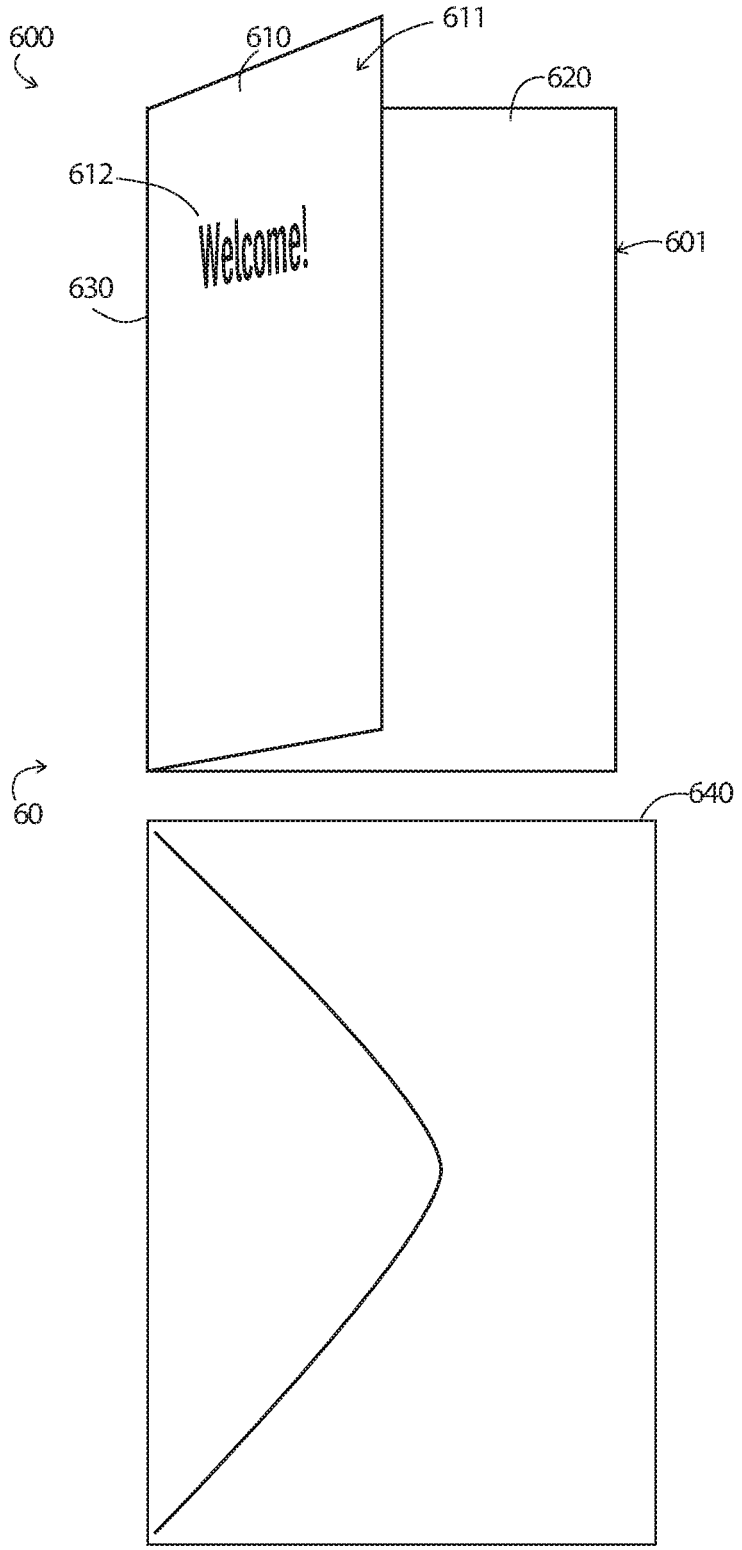
FIG. 11 depicts an example system consistent with the technology disclosed herein.

FIG. 11 depicts an example system 60 consistent with some embodiments of the technology disclosed herein. Similar to the embodiments disclosed above, a liquid absorptive sponge cloth 601 forms the card 600 that has a first panel 610 and a second panel 620. A fold line 630 is defined between the first panel 610 and the second panel 620. A printed communication 612 is disposed on a first surface 611 of the first panel 610. In this example, the card 600 is a greeting card.

In addition to a card 600, the system 60 has a sealable envelope 640 that is configured to receive the card 600. The sealable envelope 640 can be consistent with envelopes generally known in the art. It should be noted that the card 600 can have a variety of different particular configurations, such as those previously described.

Figure 12:
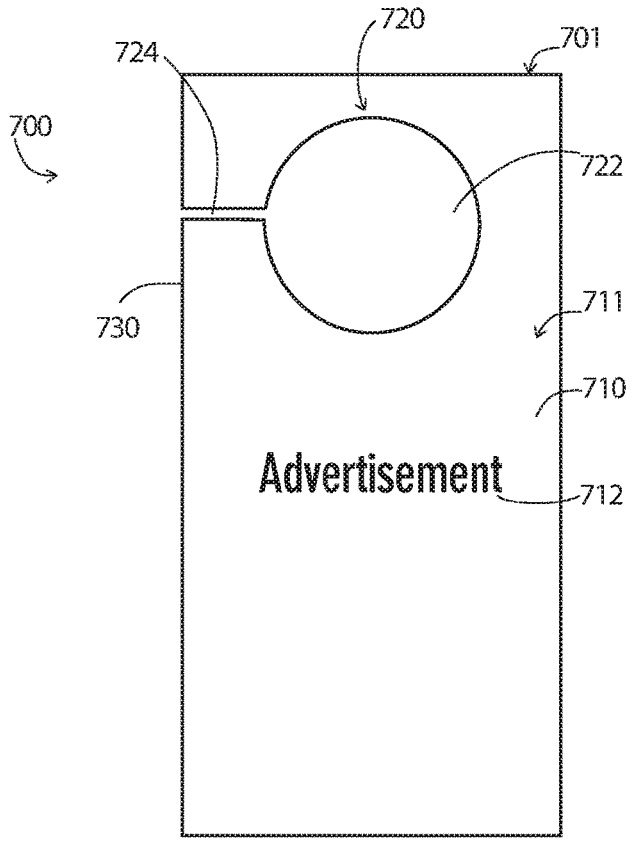
FIG. 12 depicts a facing view of another example consistent with the technology disclosed herein.

FIG. 12 depicts an alternate example implementation consistent with some embodiments of the technology disclosed herein. The example implementation is a hanger 700 formed from a liquid absorptive sponge cloth 701. The sponge cloth 701 forms a first panel 710 having a first edge 730 and a first surface 711. A printed communication 712 is disposed on the first surface 711 of the first panel 710. The printed communication 712 is an advertisement, in the current example, although other types of printed information can be provided. In some embodiments a second surface (not currently visible), opposite the first surface 711, can also have a printed communication.

An opening 720 is defined through the first panel 710. The opening 720 has a main portion 722 that is configured to receive a structure such as a door handle or a portion of a product (such as a neck of a bottle) and a slit portion 724 that extends from the first edge 730 to the main portion 722. The slit portion 724 is configured to allow the hanger 700 to be manipulated over the structure such that the main portion 722 can be positioned around the structure.

Figure 13:
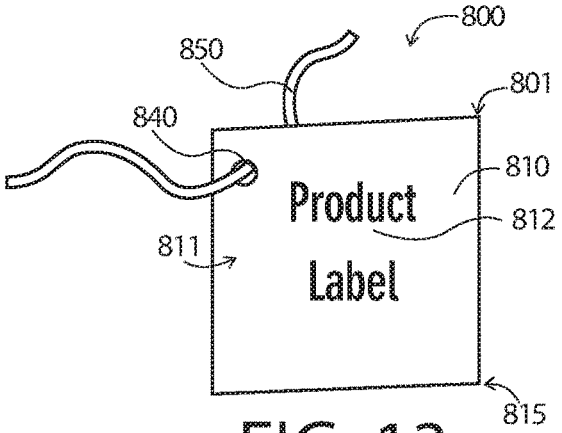
FIG. 13 depicts a perspective view of another example consistent with the technology disclosed herein.

FIG. 13 depicts another alternate example implementation consistent with some embodiments. The example implementation is a hang tag 800 that can be used to provide product information, advertisements, instructions, greetings, and the like. The hang tag 800 has a sponge cloth 801 forming a card 815 that has at least a first panel 810 and an opening 840 through the first panel 810. A printed communication 812 is disposed on a first surface 811 of the first panel 810. A hanger 850 is disposed through the opening 840 of the first panel 810. The hanger 850 is generally configured to couple the hang tag 800 to another item such as a product, vehicle, door handle, and the like. In some embodiments the hanger 850 is a flexible structure such as an elastic band, string, or a cable tie, and in some other embodiments the hanger 850 is a more rigid structure, such as a clip.

Figure 14:
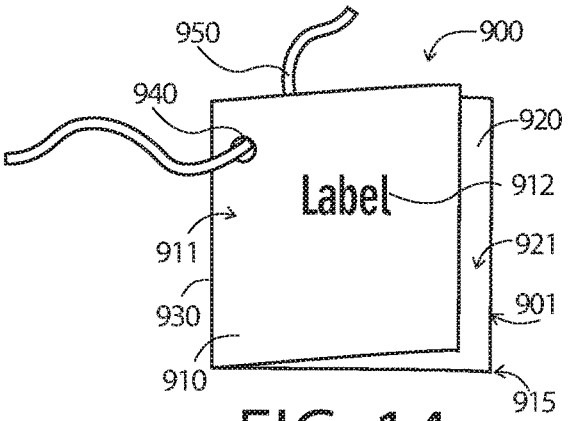
FIG. 14 depicts a perspective view of another example consistent with the technology disclosed herein.

FIG. 14 depicts another alternate example implementation consistent with some embodiments. The example implementation is another example hang tag 900. The hang tag 900 has a sponge cloth 901 forming a card 915 that defines at least a first panel 910 and an opening 940 through the first panel 910. A printed communication 912 is disposed on a first surface 911 of the first panel 910. A hanger 950 is disposed through the opening 940 of the first panel 910, where the hanger 950 is described in more detail above.

In the current example, the hang tag 900 also has a second panel 920 that is defined by the sponge cloth 901. A fold line 930 is defined between the first panel 910 and the second panel 920. The fold line 930 can be similar to fold lines discussed hereinabove. In some embodiments, the fold line 930 can be defined by a first sheet of material, similar to that described above with respect to FIGS. 7-9. Although not currently depicted, a first surface 921 of the second panel 920 can have a printed communication disposed thereon.

While the examples disclosed herein are reflected as having rectangular configurations, it will be appreciated that the components described herein can have any other shapes. Cards can have circular shapes, ovular shapes, irregular shapes, and so on.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as "arranged", "arranged and configured", "constructed and arranged", "constructed", "manufactured and arranged", and the like.

All publications and patent applications in this specification are indicative of the level of ordinary skill in the art to which the present technology pertains. All publications and patent applications are herein incorporated by reference to the same extent as if each individual publication or patent application was specifically and individually indicated by reference.

This application is intended to cover adaptations or variations of the present subject matter. It is to be understood that the above description is intended to be illustrative, and not restrictive.

I claim:

1. A card comprising:
- a liquid absorptive sponge cloth forming a first panel and a second panel;
- a fold line defined between the first panel and the second panel;
- a first sheet of material comprising a material alternate to the sponge cloth, wherein the first sheet of material is bonded to each of the first panel and the second panel; and
- a printed communication on a first surface of the first panel,
- wherein the sponge cloth is semi-rigid when substantially dry and is non-rigid upon saturation with liquid water, and wherein the sponge cloth has a maximum tensile strength of at least 2.66 lbs./in when wet.

2. The card of claim 1, wherein the fold line is defined by the first sheet of material, wherein the first sheet of material bonds the first panel and the second panel.

3. The card of claim 1, wherein the first sheet of material comprises paper.

4. The card of claim 1, wherein the sponge cloth comprises cellulose and cotton fibers.

5. The card of claim 1, wherein the sponge cloth is configured to absorb at least 0.15 quarts of water per square foot.

6. The card of claim 1, wherein the card defines a greeting card.

7. The card of claim 1, further comprising a paper insert disposed between the first panel and second panel, wherein the paper insert is coupled to the card.

8. The card of claim 1, wherein the printed communication is one or more in the group consisting of: a drawing, a greeting, an instruction, an advertisement, an invitation, a well-wish, and a product tag.

9. The card of claim 1, wherein the first panel and second panel are stitched along the fold line.

10. The card of claim 1, wherein the fold line comprises perforations.

11. A card comprising:
- a liquid absorptive sponge cloth forming a first panel and a second panel;
- a fold line defined between the first panel and the second panel;
- a printed communication on a first surface of the first panel, wherein the sponge cloth is semi-rigid when substantially dry and is non-rigid upon saturation with liquid water, and wherein the sponge cloth has a maximum tensile strength of at least 2.66 lbs./in when wet; and
- a paper insert disposed between the first panel and the second panel, wherein the paper insert is coupled to the card.

12. The card of claim 11, wherein the fold line comprises perforations.

13. The card of claim 11, wherein the first panel is stitched along the fold line.

14. The card of claim 11, wherein the fold line is defined by a first sheet of material, wherein the first sheet of material is a material alternate to the sponge cloth and the first sheet of material bonds the first panel and the second panel.

15. The card of claim 11, wherein the card defines at least one in the group consisting of: a drawing, a greeting, an instruction, an advertisement, an invitation, a well-wish, and a product tag.

* * * * *